United States Patent [19]

Hannemann

[11] Patent Number: 4,771,554

[45] Date of Patent: Sep. 20, 1988

[54] HEEL SHOE CONSTRUCTION

[75] Inventor: Bernd Hannemann, Bridgewater, Mass.

[73] Assignee: Foot-Joy, Inc., Brockton, Mass.

[21] Appl. No.: 39,338

[22] Filed: Apr. 17, 1987

[51] Int. Cl.[4] ..... A43B 21/30

[52] U.S. Cl. ..... 36/27; 36/38

[58] Field of Search ..... 36/37, 38, 27, 7.8, 36/35 R

[56] References Cited

U.S. PATENT DOCUMENTS

| | | | |
|---|---|---|---|
| 324,065 | 8/1885 | Andrews | 36/37 |
| 658,234 | 9/1900 | Cartier | 36/37 |
| 976,788 | 11/1910 | Dow | 36/37 |
| 2,447,603 | 8/1948 | Snyder | 36/38 |
| 2,508,318 | 5/1950 | Wallach | 36/38 |
| 4,492,046 | 1/1985 | Kosova | 36/27 |
| 4,566,206 | 1/1986 | Weber | 36/27 |
| 4,592,153 | 6/1986 | Jacinto | 36/27 |
| 4,638,575 | 1/1987 | Illustrato | 36/38 |

FOREIGN PATENT DOCUMENTS

| | | | |
|---|---|---|---|
| 633409 | 2/1962 | Italy | 36/38 |
| 591740 | 8/1947 | United Kingdom | 36/38 |

*Primary Examiner*—Steven N. Meyers

*Attorney, Agent, or Firm*—Pennie & Edmonds

[57] ABSTRACT

A deflectable heel insert for use in the heel portion of a footwear. The heel insert includes at least one load-bearing plate which is deflectable under loads exerted by the heel of a shoe wearer. The plate is supported above a plate support surface as part of the heel or a base plate forming part of the laminate heel construction.

4 Claims, 2 Drawing Sheets

HEEL SHOE CONSTRUCTION

BACKGROUND OF THE INVENTION

Numerous heel structures for shoes have been proposed including heels having hollow portions (U.S. Pat. Nos. 914,674 and 3,608,125); and devices placed in the hollow portions for comfort and other purposes (U.S. Pat. Nos. 733,157; 2,102,067; and 2,394,281).

SUMMARY OF THE INVENTION

Broadly, the present invention comprises a heel construction including a surface-engaging shoe heel, a deflectable heel insert and upper heel portion. The heel insert includes at least one load-bearing plate of selected material and thickness so that it is deflectable under the loads exerted by the heel of a shoe wearer. The plate is supported above a plate support surface as part of the heel or a base plate forming part of the laminate heel construction.

DESCRIPTION OF THE PREFERRED EMBODIMENT

Figure 1:
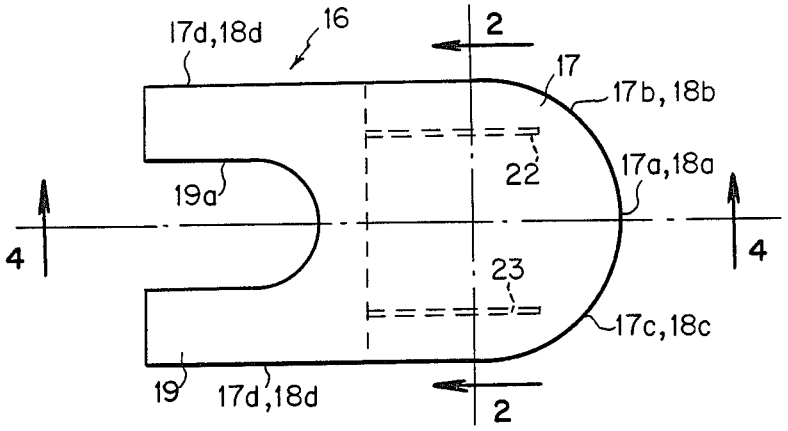
FIG. 1 is an enlarged plan view of the shoe heel insert.
Figure 2:
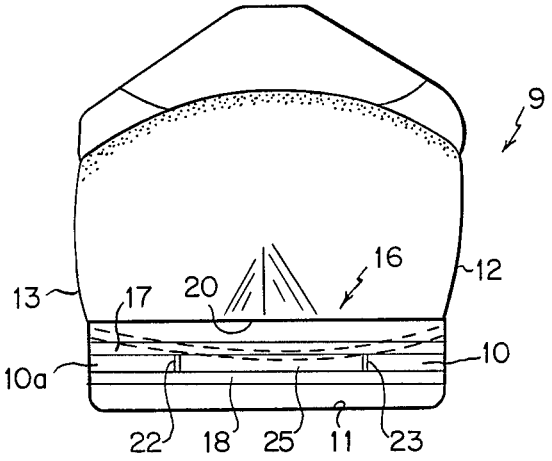
FIG. 2 shows an end elevational view of the insert located in the shoe heel.
Figure 3:
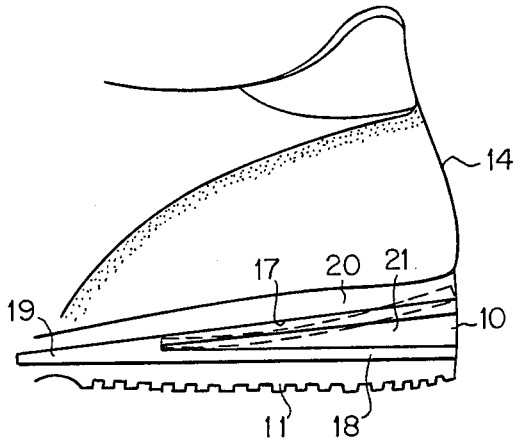
FIG. 3 shows a side elevational view of the insert in the shoe heel.
Figure 4:
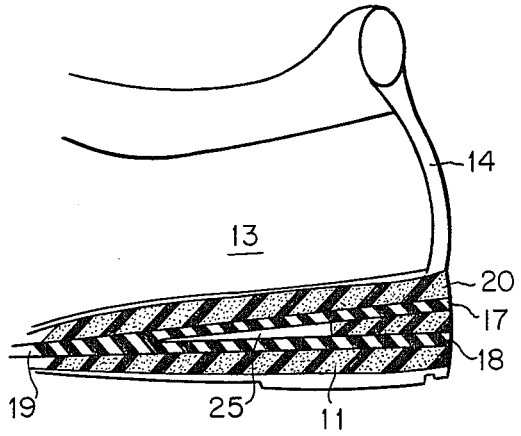
FIG. 4 is a partial sectional view taken along line 4—4 of FIG. 1.

In FIGS. 1–3, shoe 9 has heel section 14 and right and left sides 12, 13 respectively. At the base of heel section 14 is upper heel sole strip 20. Heel insert 16 is positioned above surface-engaging heel portion 11 and below heel end 14. Insert 16 has a width such that its edges are co-terminous with the sides of sole strip 20 and heel portion 11. Insert 16 is visible along the sides and at the end of the shoe 9. Alternatively, insert 16 may be narrower than the heel and concealed in the heel.

Heel insert 16 is comprised of two spaced-apart upper and lower plates 17, 18 respectively. Plates 17 and 18 are positioned with respect to one another at an acute angle (the angle is preferably a degree or more). The intersection of plates 17 and 18 provides a wedge section 19 at one end while the volume between the plates 17, 18 at the other end creates a hollow chamber 25. Wedge section 19 has cutout portion 19*a*. Plates 17, 18 having rounded rear ends 17*a*, 18*a* and rounded side edges 17*b*, 18*b*, 17*c*, 18*c* and straight edges 17*d*, 18*d* are braced apart by two spaced-apart vertical triangularly shaped spacer plate supports 22, 23. The space between plates 17, 18 outside and to the rear of supports 22, 23 is filled with compressible filler material such as ethyl vinyl acetate 10. Plate supports 22, 23 may be located at other positions to provide adequate support of upper plate 17. A single support may be used provided it is wide enough to provide adequate support. Heel insert 16 can be made of wood, plastic, rubber or other material provided that upper load-bearing plate is flexible enough to be deformable under the weight of the person wearing the shoe including the forces generated in normal walking as well as during active sports. Preferably, the heel insert 16 including its plates 17, 18 and spacer plate supports 22, 23 is integrally molded.

In the operation of shoe 9 with heel insert 16 in place, the weight of the shoe wearer will from time to time cause the wearer's heel to apply through sole heel strip 20 forces to load-bearing plate 17 causing it to deform as viewed laterally (see dashed lines of FIG. 2 and to deform longitudinally (see dashed lines of FIG. 3). Deformation shown is exaggerated for illustrative purposes. Plate 18 will similarly deform under load. Through such plate deformation, together with compression of the filler material sustained forces and short term forces applied to the wearer's heel are reduced or altered for greater comfort and safety.

Under circumstances in which the wearer's heel applies forces to the rear of the plate supports 22, 23, the rearward end of upper plate 17 will deform downwardly toward lower plate 18. Lower plate 18 is not required when surface-engaging heel 11 provides a satisfactory foundation for plate supports 22, 23.

I claim:

1. A shoe heel construction comprising (a) a laminate shoe heel for supporting a shoe wearer's heel which shoe heel includes a surface-bearing heel portion;

(b) a bottom support surface in the heel portion;

(c) a heel insert located above the heel portion which insert in turn comprises (i) a deformable upper plate having curved side edges and a curved rear edge, said upper plate lying in a plane oriented to receive forces applied by a wearer's heel directly or indirectly; and (ii) two spaced-apart support means each spaced from said side edges of the upper plate and supporting said plate above the bottom surface of the heel portion;

whereby upon application of a force by the wearer's heel on the upper plate, the upper plate is deformed about the support means toward said bottom surface.

2. The heel construction of claim 1 in which the insert includes, in addition, a lower plate at an angle positioned to the upper plate on the bottom support surface.

3. The heel construction of claim 2 in which the heel insert has in addition a wedge portion adjacent the intersection of upper and lower plates and in which the plates, wedge portion, and support means are integrally molded as a unit and thereafter formed as part of shoe heel.

4. The heel construction of claim 2 in which filler material is placed between the upper and lower plates around the side edges leaving an internal hollow chamber.

* * * * *